US006910454B2

(12) United States Patent
Sieber et al.

(10) Patent No.: US 6,910,454 B2
(45) Date of Patent: Jun. 28, 2005

(54) METHOD OF AND DEVICE FOR OPERATING A MULTI-CYLINDER COMBUSTION ENGINE WITH VARIABLE COMPRESSION RATIO

(75) Inventors: Udo Sieber, Bietigheim (DE); Jochen Laubender, Stuttgart (DE); Andre-Francisco Casal Kulzer, Boeblingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/738,099

(22) Filed: Dec. 17, 2003

(65) Prior Publication Data

US 2004/0144342 A1 Jul. 29, 2004

(30) Foreign Application Priority Data

Dec. 17, 2002 (DE) ..... 102 58 872

(51) Int. Cl.[7] ..... F01L 13/08; F02B 75/04

(52) U.S. Cl. ..... 123/182.1; 123/48 B; 123/78 F

(58) Field of Search ..... 123/48 R, 48 B, 123/78 R, 78 F, 182.1, 179.5

(56) References Cited

U.S. PATENT DOCUMENTS

| | | | | |
|---|---|---|---|---|
| 3,970,056 A | * | 7/1976 | Morris | 123/48 D |
| 4,890,585 A | * | 1/1990 | Hathorn | 123/48 A |
| 5,687,682 A | * | 11/1997 | Rembold et al. | 123/179.5 |
| 6,098,585 A | * | 8/2000 | Brehob et al. | 123/179.5 |

FOREIGN PATENT DOCUMENTS

| | | | | |
|---|---|---|---|---|
| DE | 100 51 271 A1 | | 4/2002 | |
| DE | 101 11 928 A1 | | 10/2002 | |
| JP | 60230549 A | * | 11/1985 | F02D/43/00 |

* cited by examiner

*Primary Examiner*—Noah P. Kamen
(74) *Attorney, Agent, or Firm*—Michael J. Striker

(57) ABSTRACT

In a multi-cylinder combustion engine with a variable compression ratio a start of the combustion engine is performed with a compression ratio which is reduced relative to compression ratios in normal operation of the combustion engine.

16 Claims, 3 Drawing Sheets

METHOD OF AND DEVICE FOR OPERATING A MULTI-CYLINDER COMBUSTION ENGINE WITH VARIABLE COMPRESSION RATIO

BACKGROUND OF THE INVENTION

The present invention relates to a method for operating a multi-cylinder combustion engine with variable compression ratio. Moreover, it also relates to a control device which controls at least the compression of a multi-cylinder combustion engine.

A method and a control device of this type are disclosed in the German patent document DE 100 51 271. The reference discloses a combustion engine with a crankshaft which is not directly supported in a motor block. Instead, the crankshaft is supported in eccentric rings, which in turn are supported rotatably in supporting bearings in the motor block. By means of an adjusting mechanics, the eccentric rings can be turned in a controlled way. During turning of the eccentric rings, the position of the crankshaft relative to the motor block changes. While the cylinders of the combustion engine are connected with the motor block, the pistons of the combustion engine which are movably guided in the cylinders are connected with the crankshaft through connecting rods of constant lengths. A change of the position of the crankshaft relative to the motor block therefore results in a change of the position of the pistons in the cylinders of the combustion engine. In particular, also the position of the upper dead point of the pistons in the cylinders changes. As a result, also the compression volumes enclosed by the pistons in their upper dead point position change. Since the lower dead point position of the piston changes in the same way as the upper dead point position, the stroke volume VH of the combustion chamber does not change with a change of the crankshaft position relative to the motor block. The change of the compression volume VC with constant stroke volumes VH implies a change of the compression ratio $\epsilon=(VH+VC)/VC$.

Alternatively to this adjusting mechanics, in which the distance between the crankshaft position and the cylinder is controllably changed, also systems are known in which the compression ratio is changed by a tilting of the motor block relative to the crankshaft position, or by a tilting of the cylinder head relative to the motor block, or by lifting or lowering of the cylinder head relative to the motor block in a controlled manner. All these methods have in common that the geometrical compression ratio $\epsilon=(VC+VH)/VC$ can be changed by a controlled change of the compression volume VC.

In contrast to conventional combustion engines, having a compression ratio $\epsilon$ which is determined by the geometry of the combustion chamber and is fixed, the thermodynamic efficiency of the combustion engine in partial load region can be increased with a variable compression. As a result consumer advantages are provided. This is connected with a reduction of the $CO_2$ emissions. The higher the compression ratio, the higher the compression end temperature. Since with increasing compression and temperature there is a danger that the combustion chamber filling in an Otto engine ignites itself (knocking), the maximum possible combustion ratio is limited by the tendency to knocking of the fuel. A reliable direct start and a faster motor high running is possible in start-stop operation.

In conventional combustion engines with fixed compression ratio the maximum compression ratio is structurally determined so that with the maximal combustion chamber filling (full load) no knocking occurs. It follows from this that with structurally fixedly predetermined combustion ratio and combustion chamber fillings under maximum possible value (partial load) critical compression and temperatures substantially are not reached. The efficiency of the combustion remains then behind an optimal efficiency. With the variable combustion this efficiency loss can be counteracted. Conventionally, the geometric compression ratio of a combustion engine with variable compression increases with increasing load (combustion chamber filling).

Independently from the above described concept, variable compression provides phenomena, that a direct start of a combustion engine must be possible with significantly avoiding of the use of electrostarters. In connection with this, the German patent document DE 101 11 928 A1 discloses that before a start, the position of a piston in a cylinder of the internal combustion engine is to be determined. In this way, the cylinder of the combustion engine is identified, whose piston is located in a working stroke. Then, fuel is injected directly into combustion chamber of the cylinder, and the combustion chamber filling is ignited directly after the injection, for releasing a self start or direct start of the combustion engine.

When this self starting concept is transferred to combustion engines with variable compression, worsened starting properties are produced than in the case of direct start concept in connection with constant compression ratio.

SUMMARY OF THE INVENTION

Accordingly, it is an object of the present invention to provide a method which improves the starting properties of a combustion engine, in which geometric compression ratio is variable in a controlled manner.

It is also an object of the present invention to provide a control device which improves the starting properties of such a combustion engine.

These objects are achieved in that, a start of a combustion engine is performed with a compression ratio which is reduced relative to a compression ratio in a normal operation of the combustion engine.

In accordance with another feature of the present invention, a control device is proposed which is formed to implement the above described method of the present invention.

As mentioned above, during a direct start the combustion energy which is required for the start is produced only by fuel injection and ignition in the cylinder, whose piston is located directly in a working stroke. A basic presumption for a corresponding direct start Is that the compression energy must be sufficiently great to bring the compression work in the cylinder which follows in the ignition sequence the first ignited cylinder.

The inventive reduction of the geometrical compression ratio reduces advantageously the above mentioned compression work. As a result, smaller combustion energies, which are released during ignition of the first combustion chamber filling during a first direct start, can be sufficient for providing the reduced compression work.

The inventive concept is thereby based on the realization that the start properties of a combustion chamber significantly depend on the introduced compression work, and this compression work to be introduced significantly depends on the geometric compression ratio $\epsilon+(VC+VH)/VC$.

The invention is further based on the realization that in combustion engines with variable geometric compression ratio in a partial load region, conventionally increased geometric compression in connection with direct start concepts can be disadvantages.

The proposed invention eliminates these disadvantages and allows a direct start also in combustion engines with variable geometric compression ratio. These advantages are achieved in that, the negative effects of a conventional control of a variable geometric compression ratio The inventive concept is thereby based on the realization that the start properties of a combustion chamber significantly depend on the introduced compression work, and this compression work to be introduced significantly depends on the geometric compression ratio $\epsilon=(VC+VH)/VC$.

The invention is further based on the realization that in a combustion engines with variable geometric compression ratio in a partial load region, conventionally increased geometric compression in connection With a direct start concepts can be disadvantages.

The proposed invention eliminates these disadvantages and allows a direct start also in combustion engines with variable geometric compression ratio. These advantages are achieved in that, the negative effects of a conventional control of a variable geometric compression ratio is not only avoided by the inventive reduction of the geometric compression ratio for a start of the combustion engine, but also synergetic effect is achieved by uniting of the direct start concept with the concept of a variable geometric compression.

In accordance with the invention it is advantageous that the start is performed with a minimal adjustable compression ratio.

Conventionally the geometric compression ratio is varied between the values of 8 and 14. It has been determined by a research that the lowest possible compression ratio provides the best start properties.

In accordance with the present invention it is further advantages when the compression ratio successively increases after a start end.

A start end in a combustion engine is conventionally defined so that, the increasing motor rotary speed exceeds a predetermined threshold value of several hundreds revolutions per minute. With the increasing of this rotary speed threshold, the combustion engine has so much rotary energy that subsequent compression works in subsequent compression strokes can be introduced without problems. Moreover, with increasing motor rotary speed, a greater driving moment is available from preceding combustions in the working stroke of an ignited cylinder. The increase of the compression ratio after a start end allows a very fast adjustment after a start of geometric compression ratios, that is advantageous for optimization of the determined dynamic efficiency and/or the exhaust gas emissions.

The geometric compression ratio depends on the compression volumes VC and the stroke volumes VH. The compression volume as known is the compression volume over a piston when it is located in its upper dead point position. The stroke volume VH as known is the volume in a cylinder between the upper and the lower dead point positions of the piston. Theoretically the geometric compression ratio can change either by a variation of the piston strokes and/or by a variation of the compression volume VC.

A reduction of $\epsilon=1+VH/VC$ can be reached by a reduction of VH or by an increase of VC. The increase of VC has the advantage, when compared with a reduction of VH, in that the combustion chamber filling in the cylinder to be ignited, which during stoppage of the combustion engine is located in a working position, is increased. Thereby also the energy release which results from the combustion of its combustion chamber filling, is advantageously increased, that facilitates a self start.

In other words, the reduction of the geometric compression ratio by an increase volume VC provides not only a significant reduction of the compression work in the cylinder which follows in the ignition sequence, but also operates so that in the motor stoppage position in the cylinder, which is located directly in the working stroke, more air mass is available in the combustion chamber (air pressure in combustion chamber=ambient pressure).

Therefore, during start with a predetermined mixture composition (lambda=1, lambda<1 , or lambda>1) more fuel is injected than in conventional start with fixed compression ratio and thereby finally a higher combustion energy can be produced. Because of the higher obtained combustion energy and simultaneously because of the smaller introducible compression work, the probability with which the combustion engine self starts is significantly increased. An additional advantage is faster rotary speed increase of the combustion engine during a self start.

It is further advantageous when the compression ratio during switch off of the combustion engine and the last compression strokes and extension strokes in a controlled manner, is changed so that the pistons of the combustion motor come to stop in predetermined position. Therefore by a control increase and/or lowering of the compression ratio in the last compression strokes and expansion strokes, the pressure and therefore the gas spring moment of the air column enclosed in the cylinders is changed in a targeted manner during swinging out of the piston, so that a predefined piston position is adjusted. Thereby in the control device for a subsequent self start that cylinder is known whose piston is located in a working position. As a result, during a subsequent self start the control device more reliably identifies this cylinder and correspondingly controls the fuel supply to this cylinder and the associated ignition.

These features facilitate the realization of a start-stop operation, or in other words an operation of the combustion engine, in which the stop phases and operation phases follow one another relatively fast. This can save fuel, for example during the operation of a motor vehicle in street traffic.

It is further advantages when at least one cylinder, which during a start of the combustion engine is first ignited, is selected in dependent of the predetermined position of the piston of the combustion motor in its stop condition.

In accordance with a preferable embodiment, first a combustible combustion chamber filling and at least one combustion chamber of the combustion motor in its stop condition is performed by injection of fuel in at least one combustion chamber, and then the combustion chamber filling is immediately ignited.

It has been shown that in particular the direct injection of fuel in a combustion chamber in connection with a reduced compression, allows a reliable direct start and a fast motor running in start-stop operation.

In accordance with another embodiment of the present invention, the start is performed as a direct start or a self start without the support of a separate starter.

This embodiment has the advantage that a battery-operated electric starter must be actuated substantially more seldom, to start the combustion engine in a start-stop operation. In addition to noise advantages resulting from the elimination of the starter noise, a further advantage is provided in the possibility to use a smaller battery or in other words a battery with a smaller capacity. Thereby both the initial manufacture and the further operation of a motor vehicle is provided with lower costs, since a smaller battery is lighter and provides weight advantage as a customer advantage.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
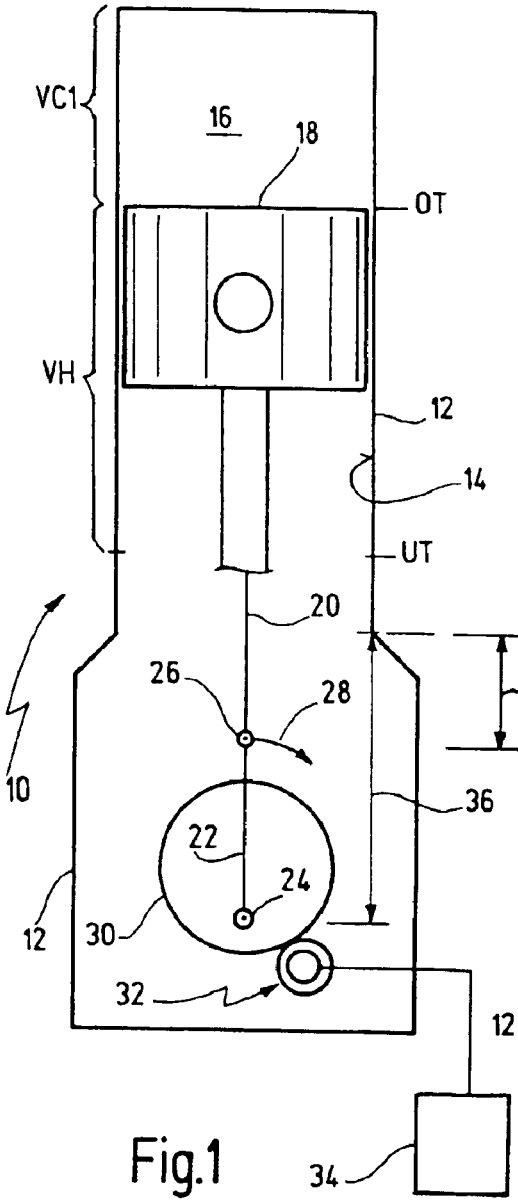
FIG. 1 is a view schematically showing a combustion engine with variable compression in condition of low compression.

In FIG. 1 a combustion chamber 10 is shown in substantially simplified form.

The combustion chamber 10 has a motor block 12, in which cylinders 14 are arranged. FIG. 1 shows one cylinder 14 of a multi-cylinder combustion engine. The remaining cylinders are arranged, for example behind the illustrated cylinder, so that FIG. 1 corresponds to a very schematic front view of a multi-cylinder series motor.

A combustion chamber 16 is movably sealed in the cylinder 14 by a piston 18 which is guided in the cylinder 14. The piston 18 is articulately connected through a connecting rod 20 with a connecting rod bearing 26 of a crankshaft 22, which is rotatably supported in the main bearings 24. The connecting rod 28 provides the rotary direction to the crankshaft 22. For realization of a variable compression the main bearings 24 are not supported the crankshaft 22 directly in the motor block 12.

Instead, the main bearings 24 are supported in eccentric rings 30 which are rotatably supported in the motor block 12. The main bearings 24 of the crankshaft 22 are arranged eccentrically in the eccentric rings 30. Therefore the main bearings 24 of the crankshaft 22 displays relative to the motor block 12 during a rotation of the eccentric rings 30. In FIG. 1 the main bearing 24 of the crankshaft 22 is located in its lowest possible position. Furthermore, the crank drive composed of the crankshaft 22 and the connecting rod 20 is located in a position which defines the upper dead point OT of the piston 18 in the cylinder 14. The volume which remains in the upper dead point OT of the piston 18 in the cylinder 14 above the piston 18 is identified as a compression volume or compaction volume VC.

In the position shown in FIG. 1, a relatively great compression volume VC is provided as a result of the lowest possible position of the crankshaft 22 in the motor block. The stroke volume VH of a cylinder 14 of the combustion chamber 10 corresponds to the volume, which the piston 18 releases during its movement from the upper dead point OT to the lower dead point UT. This stroke volume VH is not influenced by a possible crankshaft displacement during the rotation of the eccentric ring 30 and thereby is invariant relative to a displacement of the crankshaft 22.

The geometric compression ration $\epsilon$ of the combustion chamber, as known, is a sum of stroke volume VH and compression volume VC standardized on the stroke volume VH. In FIG. 1 reference numeral 32 represents an adjustment member, with which a rotary position of the eccentric ring 30 is changeable in a manner predetermined by a control device 34. The adjustment member 32 can be formed for example as an electric motor drive which is operationally coupled with the eccentric ring 30 through a toothed gear drive or a worn drive. As mentioned above, the crankshaft 22 in FIG. 1 is located in its lowest position relative to the motor block 12. With the lowest position of the crankshaft 22, positively a maximum possible compression volume VC1 is provided. FIG. 1 represents the combustion motor 10 with a variable compression in condition of a maximum low compression ratio.

Figure 2:
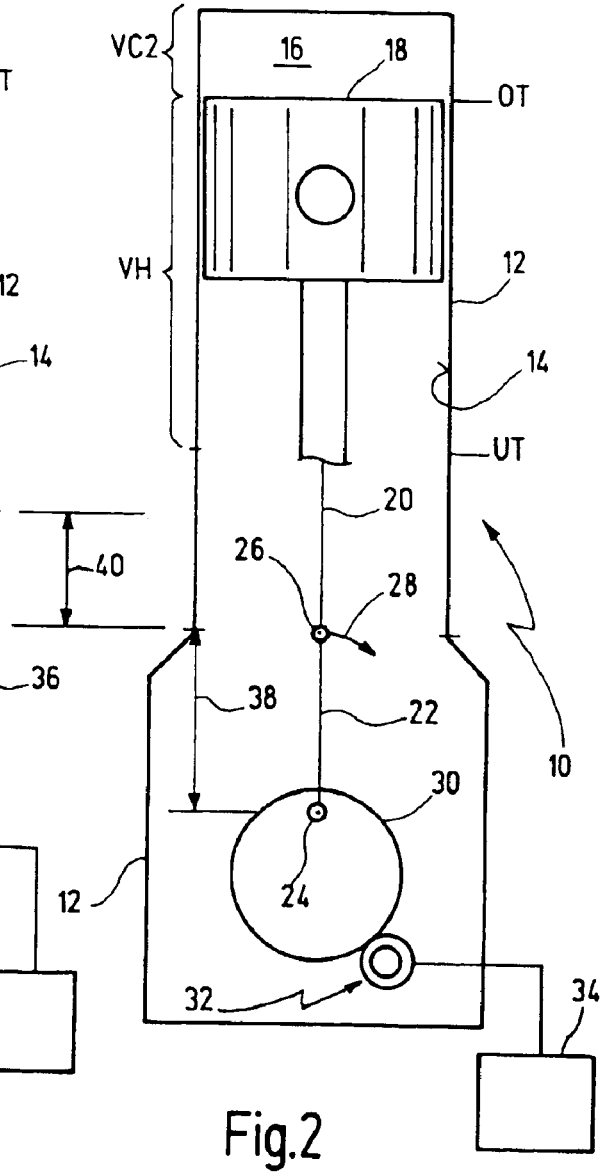
FIG. 2 is a view schematically showing the combustion engine in condition of high compression.

FIG. 2 shows the combustion motor 10 with variable compression of FIG. 1, in condition with the highest possible compression ratio. In deviation from FIG. 1, the main bearing 22 of the crankshaft 24 is located in FIG. 2 in the highest possible position with respect to the motor block 13. Thereby the compression volume VC is reduced to a minimum value VC2.

The relative position of the main bearing 24 of the crankshaft 22 to the motor block 12 is represented in FIG. 1 by the length of arrow 36. In FIG. 2, the length of the arrow 38 represents the relative position of the main bearing 24 of the crankshaft 22 in the motor block 12. Arrow 40 which is a difference of the length of the arrows 36 and 38 represents the magnitude of the crankshaft displacement between FIGS. 1 and 2. Also, the dead points UT, OT of the movement of the piston 18 and the cylinder 14 are displaced by this magnitude of the length of the arrow 40. For this reason the compression volume enclosed in the cylinder 14 changes proportionally to the displacement of the crankshaft 22.

Figure 3:
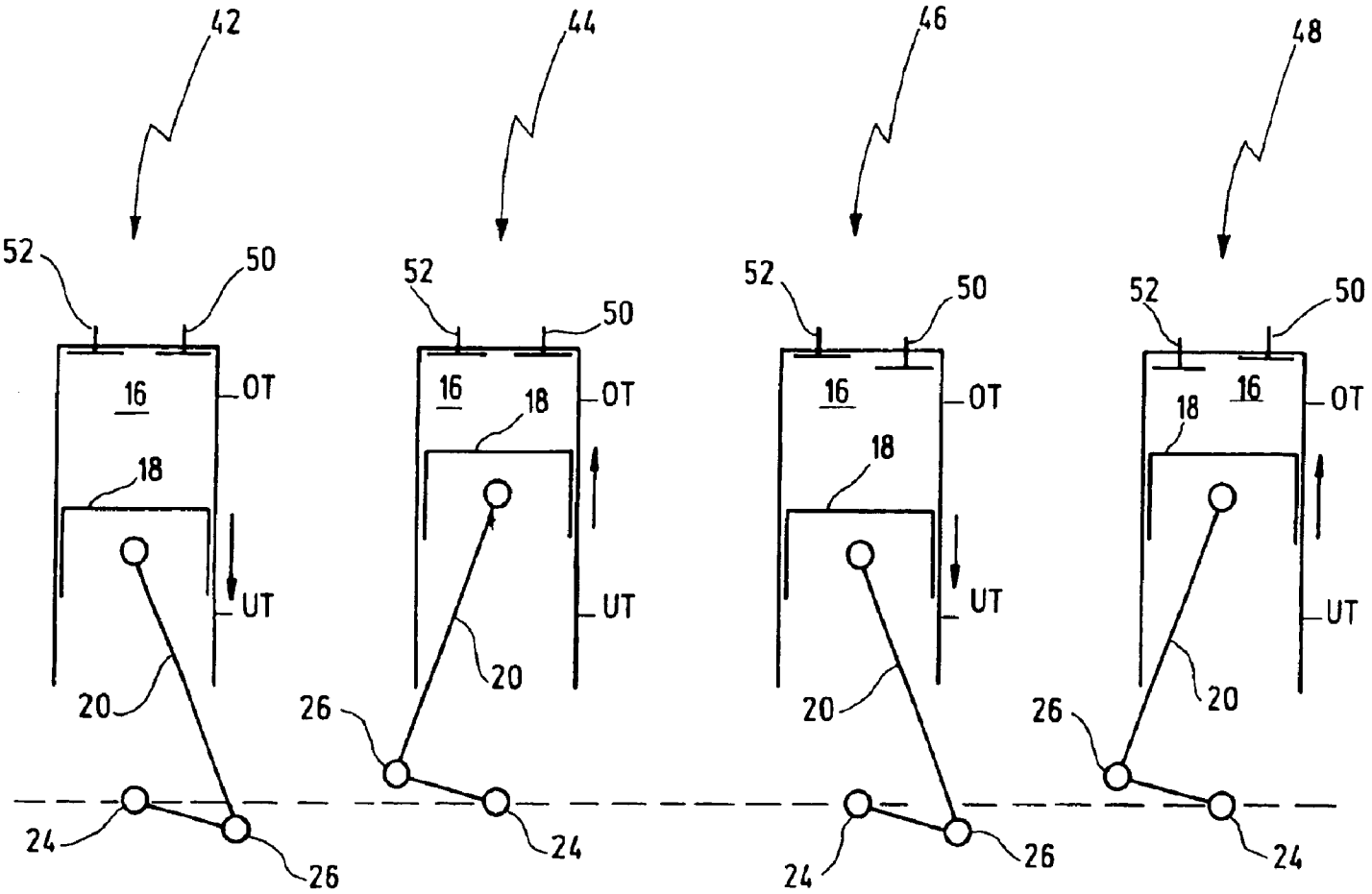
FIG. 3 is a view schematically showing an arrangement of four pistons of a four-cylinder combustion engine for different strokes of a working cycle of the combustion engine in condition of low compression.

FIG. 3 schematically shows an arrangement of four pistons of a four-cylinder combustion engine with respect to the four strokes of a working cycle. In other words, FIG. 3 shows an instantaneous assumption of the piston positions in different cylinders. The four cylinders are arranged from left to right in FIG. 3 in the typical ignition series sequence (ignition sequence) of a four-cylinder combustion engine. Arrow 42 represents for example cylinder 1, arrow 44 represents cylinder 3, arrow 46 represents cylinder 4, and arrow 48 represents cylinder 2.

Reference numeral 50 identifies an inlet valve of a cylinder and reference numeral 52 identifies an outlet valve of a cylinder. In cylinder 1 both the inlet valve 50 and the outlet valve 52 are closed during a downward movement of the piston 18. Cylinder 1 is located in a working stroke. In correspondence with the ignition sequence and in coordination with the shown opening conditions of the valves 50, 52, the cylinder 3 (arrow 44) is located in a compression stroke, the cylinder 4 (arrow 46) is located in a suction stroke, the cylinder 2 (arrow 44) is located in an ejection stroke. In all four strokes gas forces act on the piston 18. In combustion stroke a relatively significant combustion force acts on the piston 18. In contrast, in compression stroke also relatively significant gas force acts brakingly on the upwardly moving piston. In contrast, in the suction stroke and ejection stroke gas forces acting brakingly on the piston are relatively small. From the integral of these forces over the corresponding path of the piston 8 between its corresponding dead point positions OT, UT, the works performed by the gas forces are obtained.

During a direct start it is exceptionally important that the sum of these works, or in other words the work balance, is positive directly in the first work stroke of the combustion engine to be started. Additionally, a friction losses must be taken into consideration. If one identifies the work performed in the work stroke with W_Verb, the work introduced in the compression stroke with W_Komp the work which to be introduced in the suction stroke with W_Ein the work to be introduced in the ejection stroke with W_Aus, and the work to be introduced for overcoming the friction with W–Reib, then the effective work W–Eff performed in the first work stroke by the combustion engine is W_Eff+ W_Verb–W_Komp–W_Aus–W_Reib. Presumption for a direct start is that W–Eff is greater already in the first stroke than 0. Since W–Verb and W–Komp in general are comparatively great relative to W–Ein, W–Aus and W–Reib, the value W–Eff depends substantially on the values W–Verb, and W–Komp.

The inventive reduction of the geometric compression ratio of the combustion motor 10 in acts connection with this as follows:

On the one hand the compression work W_Komp is reduced. This effect alone is favorable for a direct start of the combustion engine 10. Moreover, the reduction of the geometric compression ratio leads, when it is caused by an increase of the compression volume VC, to the situation that the filling of the combustion chamber 16 above the corresponding piston 18 located in the work stroke is increased. From the increased combustion chamber filling, a potential greater combustion energy is produced, which in the first work stroke performs the combustion work W–Verb on the piston 18.

Figure 4:
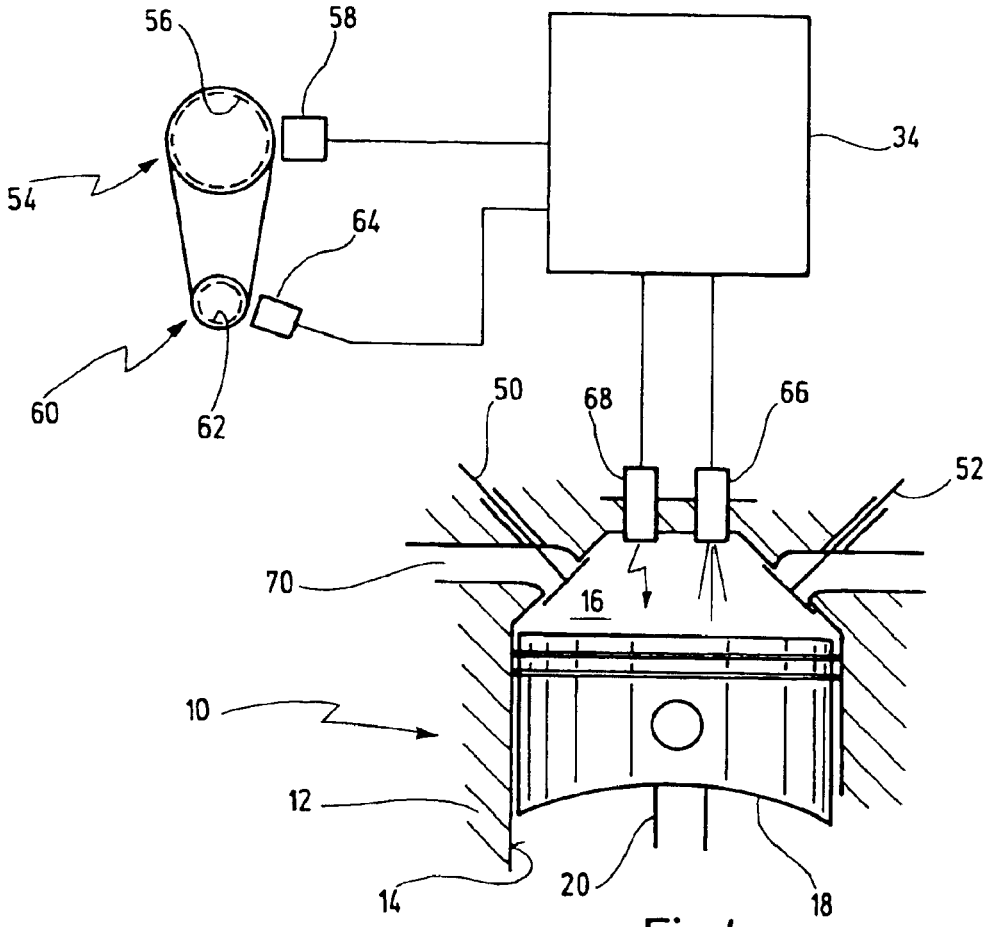
FIG. 4 is a view schematically showing a combustion chamber of the combustion engine with adjusting members, sensors and a control device.
Figure 5:
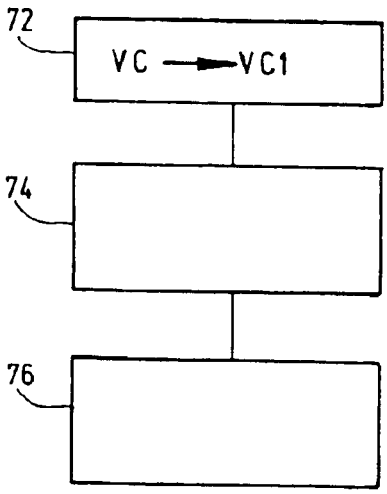
FIG. 5 is a view showing a flow diagram as an embodiment of a method in accordance with the present invention.

FIG. 4 schematically shows a combustion chamber 16 of the combustion engine 10 with adjusting members 66, 68, sensors 58, 64 and a first control device 34 which controls the performance of the presented method. Reference numeral 54 in FIG. 4 represents a camshaft transmitter wheel provided with marks 56. During a rotation of the camshaft transmitter wheel 54, a camshaft sensor 58 senses the marks 54 and supplies a signal to the control device 34, which obtains from it an information about the angular position of the camshaft. The camshaft sensor 58 can be formed for example as an optical sensor or as an inductive pickup receiver. Correspondingly, the marks 56 in the case of the use of an optical sensor 58 can be formed as regions with different reflection properties and for transmission properties. In case of an inductive receiver 58, the marks 56 can be formed for example as ferromagnetic marks, for example as teeth.

In a four-stroke cycle all piston positions can be produced in the four strokes in correspondence with angular positions of the camshaft. With a sufficient resolution of the sensor system composed of the camshaft transmitter wheel 54 with the marks 56 and the camshaft sensor 58, it is possible to accurately identify the cylinder whose piston is located in a work stroke position.

In addition to the camshaft sensor system 54, 56, 58, also a crankshaft sensor system 60, 62, 64 can be used and composed of a transmitter wheel 60, marks 62, and a sensor 64. In this case it is recommended that the camshaft sensor system 54, 56, 58 supplies a signal which indicates whether the combustion engine is located in the first half or the second half of a four-stroke cycle. A finer resolution through the accurate position inside the first or the second half of the four-stroke cycle in this case is provided by the crankshaft sensor 64, whose signals are also transmitted to the control device 34.

Advantageously, an absolute angle sensor system is used, which supplies a signal about the angular position of the crankshaft and/or camshaft even with stopping crankshaft 2. In particular optical or magneto-resistive sensors can be used as absolute angular sensors. In case of the use of inductive pickup sensors, advantageously during turning off of the combustion engine the angular position is determined, in which the combustion engine 10 or its crankshaft 22 come to stop. This can be performed during turning off since the sensors can reliably identify the operating cylinder with running the combustion engine 10.

During a conventional start of the combustion engine 10 with an electric starter, an inductive pickup sensor conventionally requires up to two crankshaft revolutions until the signals supplied by the sensors can be accurately synchronized with the actual angular crankshaft. For reliably identifying after a turning off during a direct start such a cylinder whose piston is located in an work position, this piston during turning off of the combustion chamber is identified and corresponding information is stored until a next start of the combustion engine in the control device 34, where it is available during the next start.

In case of an absolute angular sensor system, a cylinder whose piston is located in a work position, can be also reliably identified during start of the combustion engine. It is important in each case that this cylinder is reliably identified for a planned selfstart.

During a planned selfstart the filling of the combustion chamber 16 of the corresponding cylinder is ignited by controlling an ignition device 68. A combustion of the filling with combustable mixture in the combustion chamber 16 takes place. In a combustion chamber with a gasoline direct injection as schematically shown in FIG. 4, an injection of fuel in the combustion chamber 16 is performed before the ignition by controlling the fuel metering device 66 by the control device 34.

The invention however is not limited to the application for combustion chambers with direct injection. In combustion chambers with suction pipe injection, in which the fuel is dosed in a suction pipe 70 of the combustion engine before the inlet valve 50 of the combustion engine, the corresponding cylinder during turning off aspirates one last time a mixture of fuel and air. This mixture is confined in the combustion chamber 16 with closed valves and can be directly ignited during a subsequent direct start.

FIG. 6 shows an embodiment of the inventive method in the form of a flow diagram. In a step 72 first the compression volume or compaction volume c of the combustion motor is adjusted to the value VC 1 which corresponds to a low compression. Comparison can be made for this purpose of showing VC1 and VC2 in FIGS. 1 and 2. In the embodiment shown in FIGS. 1 and 2, the method is performed so that the control device 34 controls the adjusting members 32 so that the eccentric ring 30 turns for example from the position shown in FIG. 2 to the position shown in FIG. 1.

The step 72 is performed preferably not during a direct start, but instead during a preceding turning off of the combustion engine 10. The basis for this is that the increase of the compression volume VC must be formed when air can be aspirated in the corresponding cylinder through open inlet valves. Only under these conditions it is guaranteed that the relatively great compression volume VC 1 is filled fully with air or mixture. As mentioned before, an increased filling contributes to the high probability with which a self start or a direct start can be performed, since thereby the energy released in the work stroke is increased.

In a step 74 subsequently the identification in the cylinder with n is performed, with which stopping of the crankshaft 22 of the combustion engine 10 is located in its work position. As described before, it this determination can be performed, depending on the type of the used sensor system, during the preceding turning off of the combustion chamber in stopped position of the combustion chamber before a self start. In a combustion chamber with a suction pipe injection, in which the corresponding cylinder aspirates already before a mixture at fuel and air from the suction pipe 10, subsequently in the steps 76 the ignition of this combustion chamber filling can be performed, that releases the desired self start. If to the contrary, the combustion engine 10 is a combustion engine with a direct injection, then between the steps 74 and 76 a control is performed of the fuel metering device 66, in which the fuel is dosed to the air introduced in the combustion chamber 16.

In other words, for facilitating the selfstart, before the starting process itself the geometric compression ratio is reduced as much as possible, whereby during the start the compression work is significantly reduced in each next cylinder in the ignition sequence. Simultaneously, due to the smaller compression the compression volumes in all cylinders of the combustion engine is increased. This means for the start process from the cylinder which is located directly in the work stroke, that during motor stopping more air mass is available in the combustion chamber (air pressure in combustion chamber=ambient pressure). Therefore during the start with a predefined mixture composition more fuel can be dosed also in a conventional start with fixed compression ratio, whereby finally a higher combustion energy can be produced. Because of the reached higher combustion energy and simultaneously smaller introducible compression work, the start and the running up of the combustion engine can be performed faster. Furthermore, with this method the start reliability during self start or direct start can be significantly increased.

The above described method can be utilized in particular in combustion engines with direct injection and selfstart function in hot start case and cold start case. In addition, the above described method can be coupled with further features, such as for example multiple injection, the use of a special start fuel, a preheating of the combustion chamber, a preheating of the motor oil, a preheating of the fuel and so on. During turning off of the combustion chamber the varying of the compression ratio can also be coupled with other features, such as for example with a targeted control of the throttle flap and a waste gas return valve, a tank ventilating valve, with an air blow in the cylinder, as well as with braking operations by coupled auxiliary aggregates, for example starter-generator.

In addition to or alternatively to the above described selfstart function, the inventive reduced compression can be used also in connection with an external starter (cranking starter), to improve the starting condition of the combustion engine 10 also to improve the cold start.

It will be understood that each of the elements described above, or two or more together, may also find a useful application in other types of constructions and methods differing from the types described above.

While the invention has been illustrated and described as embodied in method of and device for operating a multi-cylinder combustion engine with variable compression ratio, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A multi-cylinder combustion engine with a variable compression ratio, comprising a plurality of cylinders; means for starting the combustion engine; and a control device for controlling at least a compression ratio of the combustion engine and comprising means for performing the starting with a minimal adjustable compression ratio; and means for performing reducing the compression ratio to the minimal adjustable compression ratio at a time of turning off of the combustion engine.

2. A method of operating a multi-cylinder combustion engine with variable compression ratio that is varied inversely to load, comprising the steps of starting the combustion engine; performing the starting of the combustion engine with a minimal adjustable compression ratio; and performing reducing of the compression ratio to the minimal adjustable compression ratio at a time of turning off of the combustion engine.

3. A method of operating a multi-cylinder combustion engine with variable compression ratio, comprising the steps of starting the combustion engine; performing the starting of the combustion engine with a minimal adjustable compression ratio; and performing reducing of the compression ratio to the minimal adjustable compression ratio at a time of turning off of the combustion engine.

4. A method as defined in claim 3, wherein performing includes increasing the compression ratio after a start end.

5. A method as defined in claim 3, wherein said performing includes changing the compression ratio during turning off of the combustion engine in a last compression stroke and expansion stroke in a controlled manner, so that pistons of the combustion engine come to a stop in predetermined positions.

6. A method as defined in claim 5; and further comprising selecting at least one cylinder which during a start of the combustion engine is first ignited, dependence on a predetermined position of pistons of the combustion engine in its stop condition.

7. A method as defined in claim 3; and further comprising providing a combustion chamber filling with at least one combustion chamber of the combustion motor in its stop condition by injecting fuel in the at least one combustion chamber; and igniting the combustion chamber filling.

8. A method as defined in claim 7; and further comprising performing the starting as a direct start without a support of a separate start.

9. A method as defined in claim 7; and further comprising performing the starting with a support of a separate starter.

10. A control device for controlling at least a compression of a multi-cylinder combustion engine, comprising means for starting the combustion engine; means for performing the starting with a minimal adjustable compression ratio;

and means for performing reducing the compression ratio to the minimal adjustable compression ratio at a time of turning off of the combustion engine.

11. A control device as defined in claim 10, wherein said means increase the compression ratio after a start end.

12. A control device as defined in claim 10, wherein said performing means change the compression ratio during turning off of the combustion engine in a last compression stroke and expansion stroke in a controlled manner, so that pistons of the combustion engine come to a stop in predetermined positions.

13. A control device as defined in claim 10, wherein said performing means select at least one cylinder in which during a start of the combustion engine is first ignited, in dependence on a predetermined position of pistons of the combustion engine in its stop condition.

14. A control device as defined in claim 10, wherein said performing means provide a combustion chamber filling with at least one combustion chamber of the combustion motor in its stop condition by injecting fuel in the at least one combustion chamber; and igniting the combustion chamber filling.

15. A control device as defined in claim 10, wherein said starting means is means for starting as a direct start without a support of a separate start.

16. A control device as defined in claim 10, wherein said starting means is means for starting with a support of a separate starter.

* * * * *